US010761460B2

(12) United States Patent
Yamada

(10) Patent No.: US 10,761,460 B2
(45) Date of Patent: Sep. 1, 2020

(54) IMAGE FORMING APPARATUS

(71) Applicant: CANON KABUSHIKI KAISHA, Tokyo (JP)

(72) Inventor: Toshiyuki Yamada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/570,495

(22) Filed: Sep. 13, 2019

(65) Prior Publication Data

US 2020/0089146 A1 Mar. 19, 2020

(30) Foreign Application Priority Data

Sep. 14, 2018 (JP) ..... 2018-173090

(51) Int. Cl.
*G03G 15/16* (2006.01)

(52) U.S. Cl.
CPC ..... *G03G 15/1675* (2013.01)

(58) Field of Classification Search
CPC ..... G03G 15/1675
See application file for complete search history.

(56) References Cited

U.S. PATENT DOCUMENTS

| | | | | |
|---|---|---|---|---|
| 8,787,784 | B2 | 7/2014 | Miyamoto et al. | |
| 2012/0063795 | A1 | 3/2012 | Funatani | |
| 2013/0330096 | A1* | 12/2013 | Mochizuki ..... | G03G 15/1645 399/66 |
| 2018/0039209 | A1* | 2/2018 | Ishizumi ..... | G03G 15/1675 |

FOREIGN PATENT DOCUMENTS

| | | | |
|---|---|---|---|
| JP | 10-207262 | A | 8/1998 |
| JP | 2004-053748 | A | 2/2004 |
| JP | 2012-063445 | A | 3/2012 |
| JP | 2012-150365 | A | 8/2012 |

* cited by examiner

*Primary Examiner* — Sandra Brase
(74) *Attorney, Agent, or Firm* — Venable LLP

(57) ABSTRACT

An image forming apparatus includes an image bearing member, a transfer member, a voltage source, a sensor, an acquiring portion, an information storing portion, and a controller configured to adjust the voltage applied to the transfer member. During continuous image formation for continuously forming images on a plurality of recording materials, a detection result of the sensor is corrected on the basis of the detection result of the sensor in a detection period in which a current recording material passes through a transfer portion, an index value relating to a toner image transferred onto a detection region passing through the transfer portion in the detecting period, and correction information, and then on the basis of the corrected value of the detection result, the controller controls the voltage applied to the transfer member for a subsequent recording material passing through the transfer portion.

9 Claims, 9 Drawing Sheets

(a)

(b)

IMAGE FORMING APPARATUS

FIELD OF THE INVENTION AND RELATED ART

The present invention relates to an image forming apparatus, such as a copying machine, a printer or a facsimile machine, of an electrophotographic type, an electrostatic recording type or the like.

Conventionally, for example, in the image forming apparatus of the electrophotographic type or the like, a toner image formed on a photosensitive member or an intermediary transfer belt as an image bearing member is transferred onto a recording material such as paper, so that an image is formed on the recording material. The transfer of the toner image from the image bearing member onto the recording material can be carried out by applying a voltage to a transfer member for forming a transfer portion in contact with the image bearing member. As the transfer member, an electroconductive transfer roller such as a rubber roller including a core metal and an electroconductive rubber layer formed on the core metal, or a sponge roller including a core metal and an electroconductive sponge-like form layer formed on the core metal has been widely used.

In such an image forming apparatus, the electroconductive transfer roller is contacted to the image bearing member and to this transfer roller, a predetermined transfer bias is applied, and then the recording material is nipped and fed through a transfer portion (transfer nip) which is a contact between the image bearing member and the transfer roller. As a result, at the transfer portion, a surface (back surface) of the recording material to which the transfer roller is contacted is electrically charged by the transfer bias. Then, by an electrostatic force of electric charge thereof, the toner image on the image bearing member is attracted to a surface (front surface) of the recording material contacting the image bearing member and thus is electrostatically transferred onto the recording material. A value of the transfer bias can be determined on the basis of a result of acquisition of information on electric resistance of the transfer portion during a pre-rotation operation before a start of image formation or during a post-rotation operation after an end of the image formation.

The transfer roller changes in electric resistance due to an environment fluctuation or a use amount thereof in some instances. Particularly, an ion-conductive transfer roller conspicuously changed in electric resistance due to a change in environment. The ion-conductive transfer roller is, for example, one in which an elastic layer is formed by incorporating an ion-conductive agent (a surface or the like) in a rubber such as NBR, EPDM or urethane, or one in which an elastic layer is formed of an ion-conductive polymer. Further, in the case where continuous image formation for continuously forming images on a plurality of recording materials is carried out, the electric resistance of the transfer roller changes, so that a value of the transfer bias applied to the transfer roller is not an appropriate value in some instances. As a result, a transfer performance lowers, so that an image quality (print quality) of an image-formed product to be outputted lowers in some instances.

Therefore, as another method of the above-described control before the start of the image formation or after the end of the image formation, a method in which a transfer current value is detected in a sheet interval during continuous image formation and then a transfer bias is corrected on the basis of a detection result of the transfer current value has been proposed (Japanese Laid-Open Patent Application JP-A Hei 10-207262). Further, a method in which a transfer current value is detected when a recording material during continuous image formation passes through a transfer portion and then a transfer bias is corrected on the basis of a detection result of the transfer current value has been proposed (JP-A 2004-53748).

According to the method described in JP-A Hei 10-207262, as regards a deviation of the transfer current value due to a change in electric resistance of a transfer roller, the transfer bias can be corrected. However, the transfer current value is detected in the sheet interval, and therefore, as regards a deviation of the transfer current value due to a change in electric resistance (such as due to a change in water content) of the recording material, the transfer bias cannot be corrected.

On the other hand, according to the method described in JP-A 2004-53748, the transfer current value is detected when the recording material passes through the transfer portion, so that it is possible to detect the change in electric resistance of the transfer roller and the change in electric resistance of the recording material in combination. For that reason, according to the method described in JP-A 2004-53748, compared with the method described in JP-A Hei 10-207262, the transfer bias can be corrected more appropriately.

However, even in a constitution in which the transfer current value is detected when the recording material passes through the transfer portion, it turned out that a deviation of a detected transfer current value occurs due to a difference in toner amount on the recording material when the transfer current value is detected and thus the transfer bias cannot be appropriately corrected in some instances.

Therefore, in order to take the influence due to the toner amount on the recording material when the transfer current value is detected into consideration, JP-A 2012-150365 discloses the following constitution. That is, during a print job, a secondary transfer current is detected at timing when a transfer toner image density highest in frequency of appearance (most frequently appearing toner image) is transferred, and a relationship between the most frequently appearing toner image and a secondary transfer current is acquired. JP-A 2012-150365 discloses that in the case where a deviation occurs in this relationship, a secondary transfer voltage is adjusted. However, in JP-A 2012-150365, as regards adjusting timing of the secondary transfer voltage, such cannot be adjusted until the most frequently appearing toner image appears.

Accordingly, a principal object of the present invention is to provide an image forming apparatus capable of not only more appropriately correcting a set value of a transfer bias during continuous image formation but also correcting the transfer bias depending on an image ratio during image formation.

SUMMARY OF THE INVENTION

According to an aspect of the present invention, there is provided an image forming apparatus comprising: an image bearing member configured to bear a toner image; a transfer member configured to transfer the toner image from the image bearing member onto a recording material at a transfer portion under application of a voltage; a voltage source configured to apply a voltage to the transfer member; a sensor configured to detect a current flowing when the voltage is applied to the transfer member by the voltage source; an acquiring portion configured to acquire an index value correlating with a toner amount of the toner image transferred onto the recording material at the transfer portion; an information storing portion configured to store correction information, determined in advance for each index value, for correcting a detection result of the sensor depending on the index value; and a controller configured to adjust the voltage applied to the transfer member, wherein during continuous image formation for continuously forming images on a plurality of recording materials, the detection result is corrected on the basis of the detection result of the sensor in a detection period in which a current recording material passes through the transfer portion, the index value relating to the toner image transferred onto a detection region passing through the transfer portion in the detecting period, and the correction information, and then on the basis of the corrected value of the detection result, the controller controls the voltage applied to the transfer member for a subsequent recording material passing through the transfer portion.

Further features of the present invention will become apparent from the following description of exemplary embodiments with reference to the attached drawings.

Figure 5:
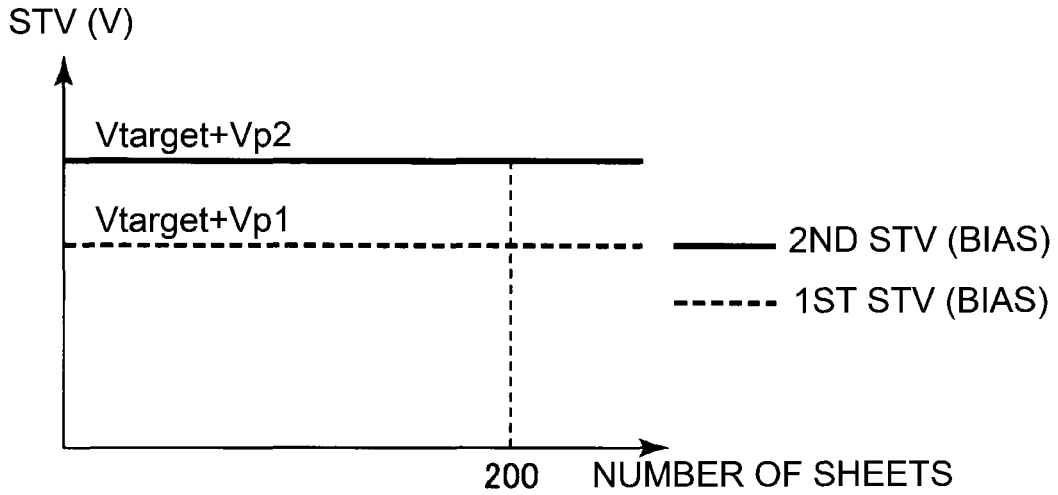
Figure 5:
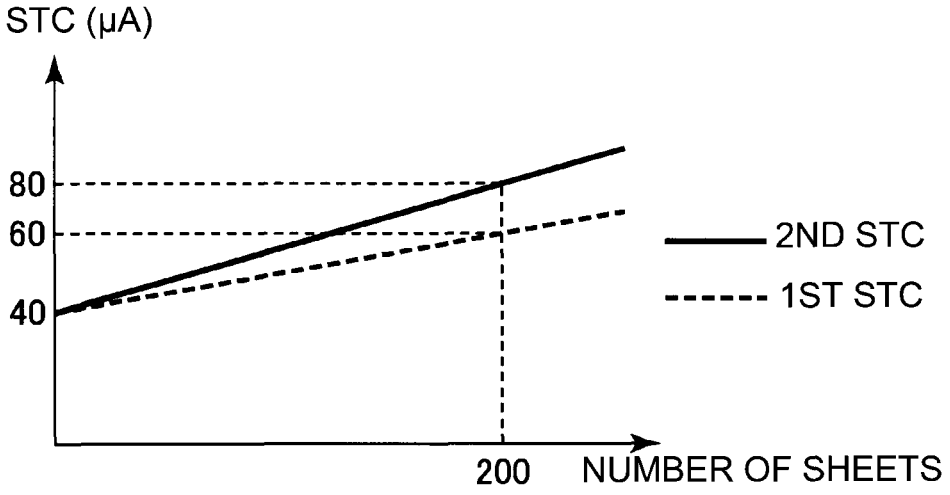

Parts (a) and (b) of FIG. 5 are graphs for illustrating an increase in secondary transfer current value.

Figure 6:
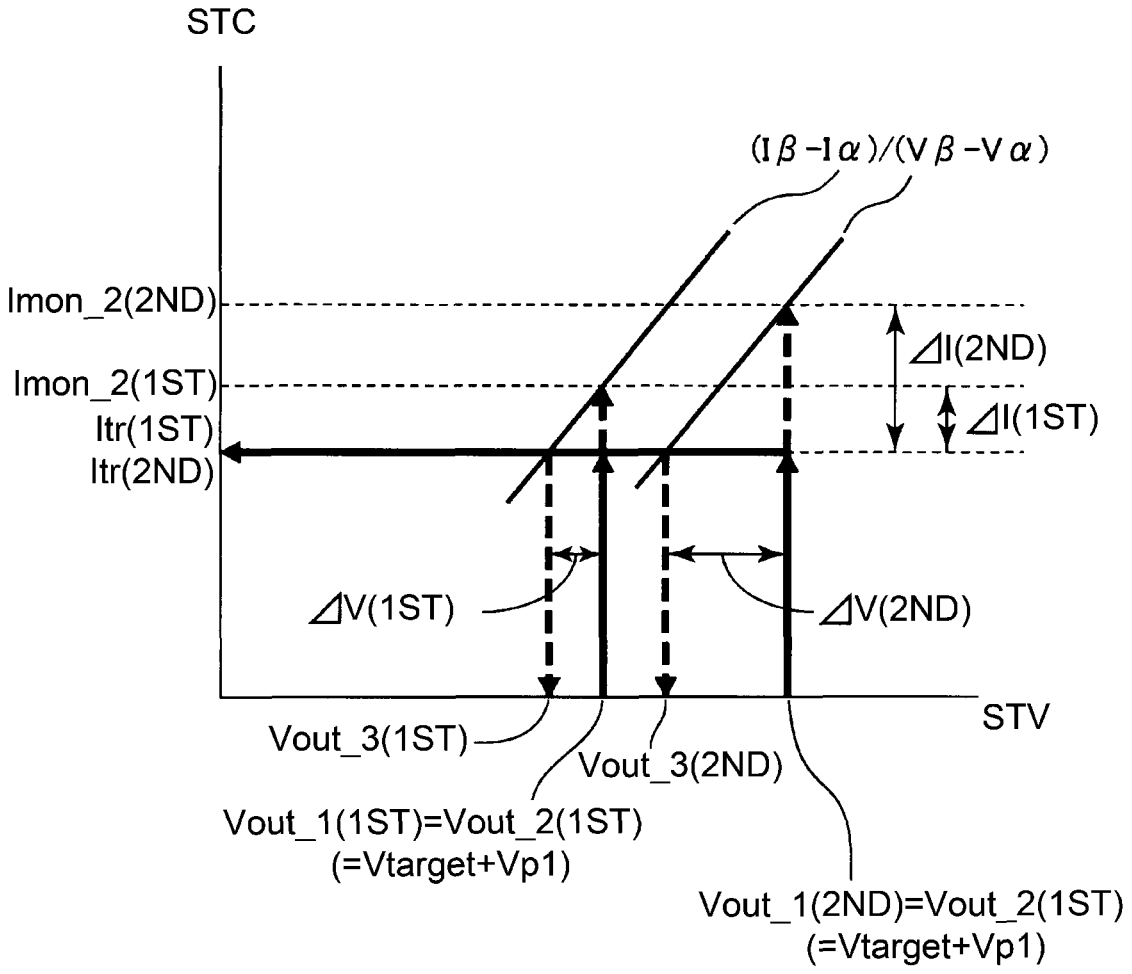

FIG. 6 is a graph for illustrating a correcting method of a set voltage value of a secondary transfer bias.

Figure 7:
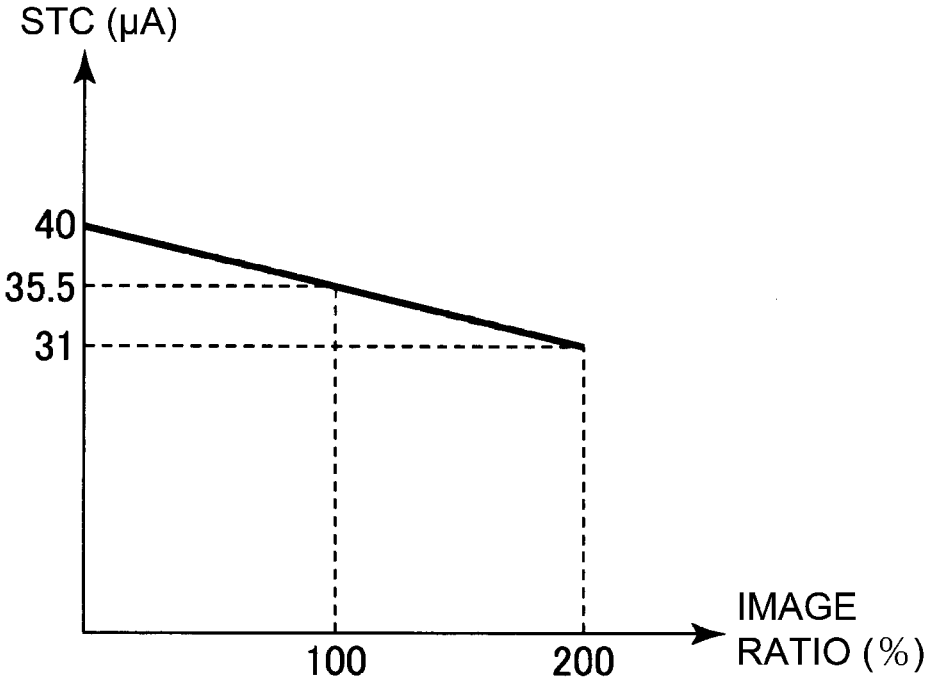

FIG. 7 is a graph for illustrating a correlation between a video count value and a secondary transfer current value.

Figure 8:
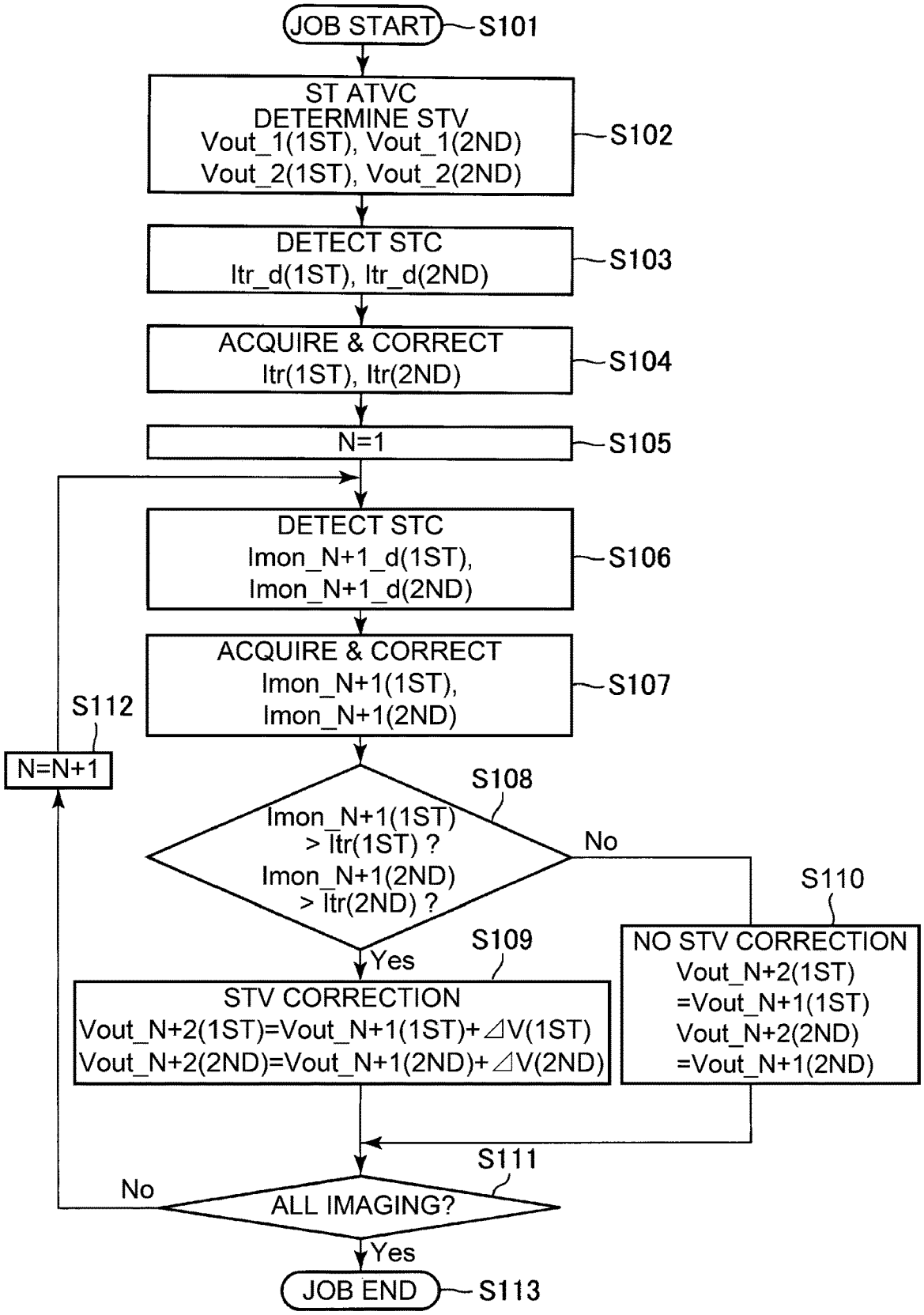

FIG. 8 is a flowchart of control in Embodiment 1.

Figure 9:
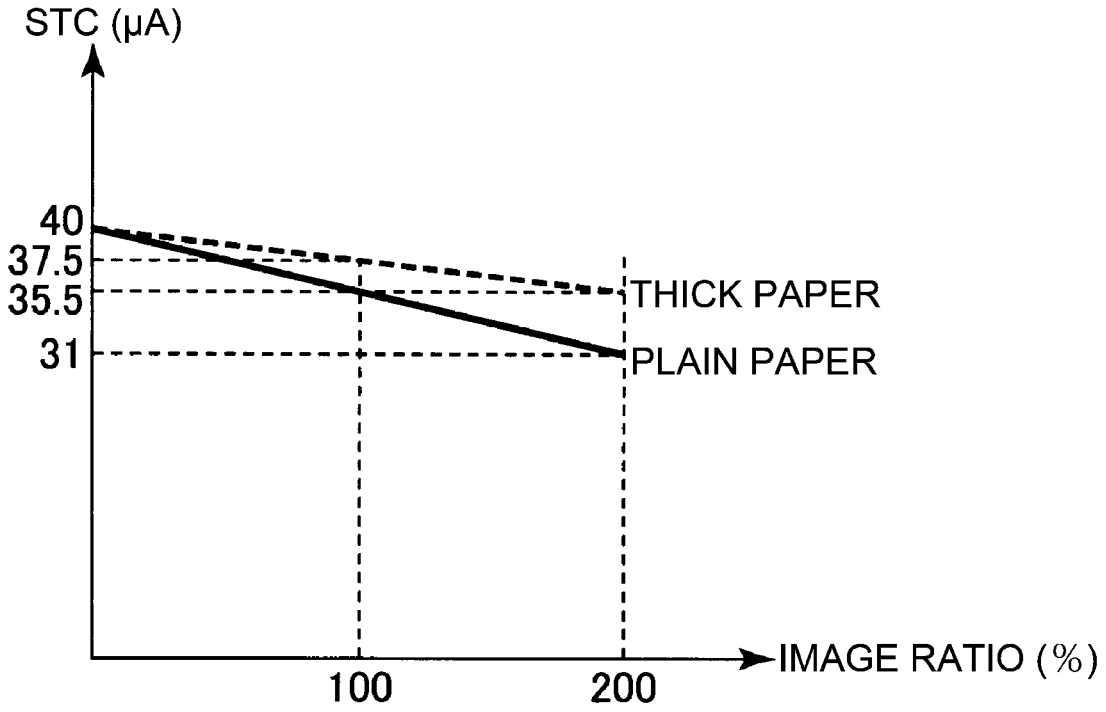

FIG. 9 is a graph for illustrating a correlation between a video count value and a secondary transfer current value.

Figure 10:
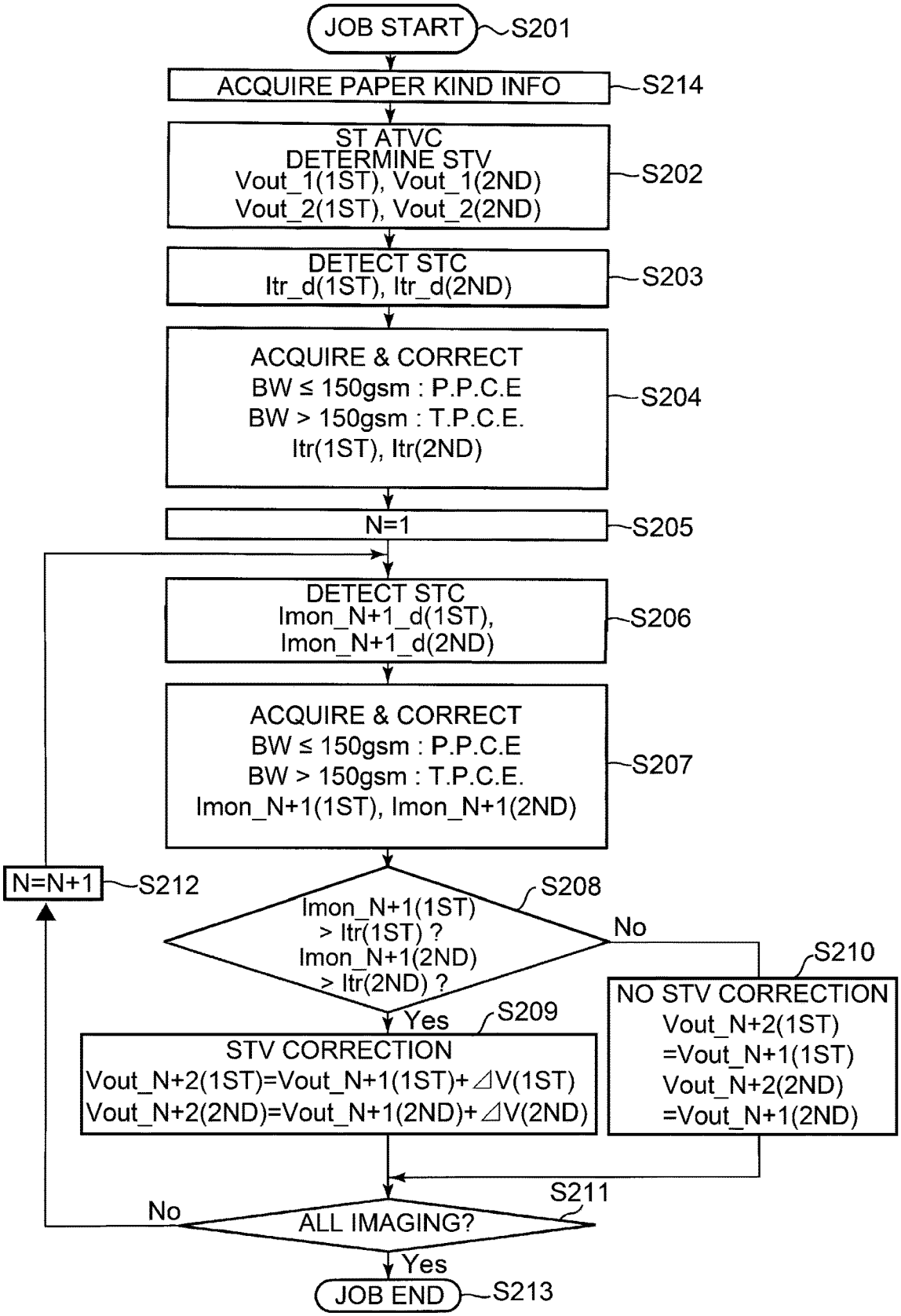

FIG. 10 is a flowchart of control in Embodiment 2.

DESCRIPTION OF EMBODIMENTS

An image forming apparatus according to the present invention will be specifically described with reference to the drawings.

Embodiment 1

1. General Constitution and Operation of Image Forming Apparatus

Figure 1:
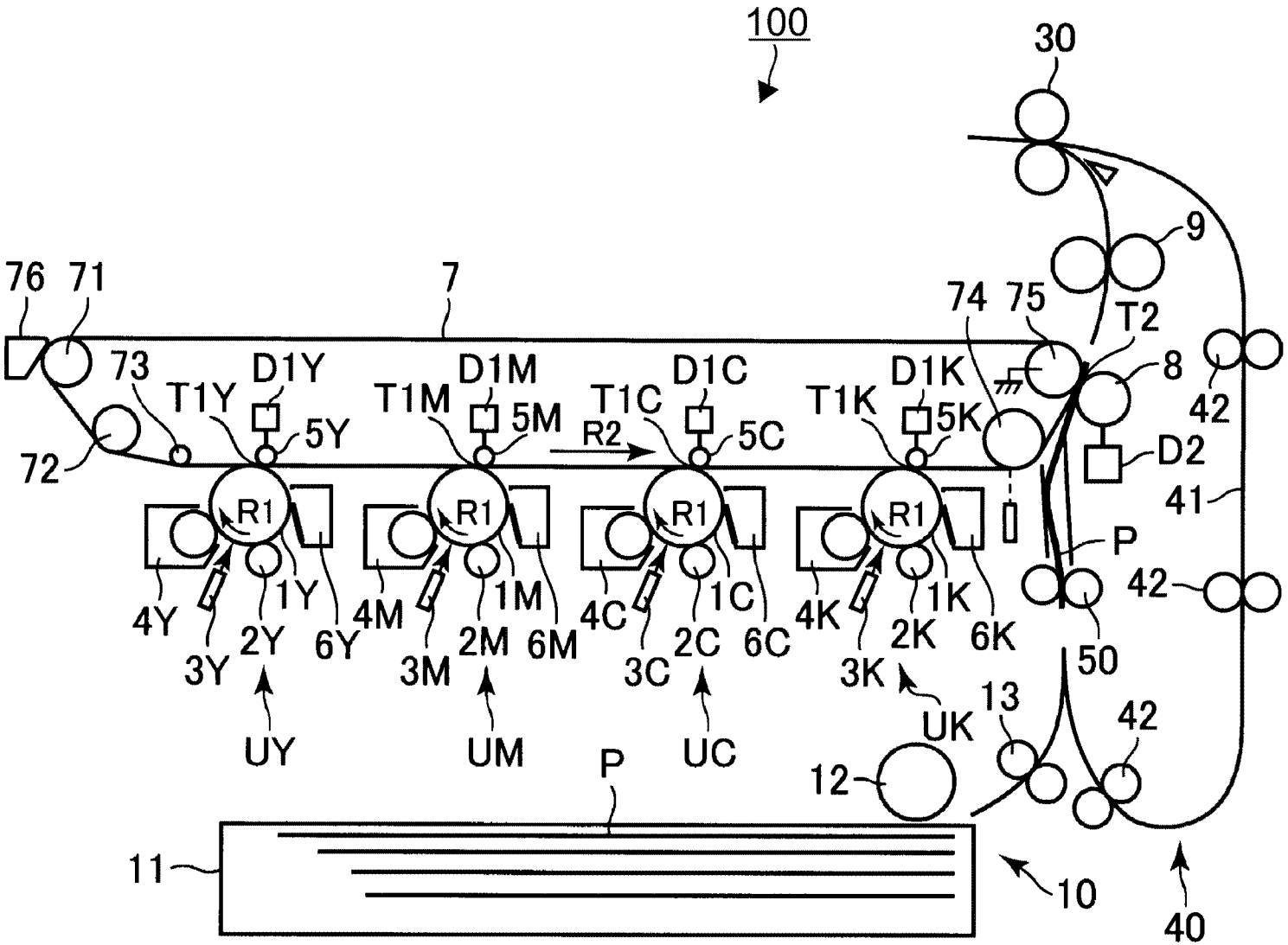
FIG. 1 is a schematic sectional view of an image forming apparatus.

FIG. 1 is a schematic sectional view of an image forming apparatus 100 of the present invention.

The image forming apparatus 100 in this embodiment is a tandem multi-function machine (having functions of a copying machine, a printer and a facsimile machine) of an electrophotographic type, which is capable of forming a full-color image using an intermediary transfer type system.

The image forming apparatus 100 includes first to fourth image forming units UY, UM, UC and UK for forming images of yellow (Y), magenta (M), cyan (C) and black (K). As regards elements of the respective image forming units UY, UM, UC and UK having the same or corresponding functions or constitutions, suffixes Y, M, C and K for representing the elements for associated colors are omitted, and the elements will be collectively described in some instances. The image forming unit U is constituted by including a photosensitive drum 1, a charging roller 2, an exposure device 3, a developing device 4, a primary transfer roller 5, a cleaning device 6 and the like, which are described later.

The image forming unit U includes the photosensitive drum 1 which is a rotatable drum-shaped photosensitive member (electrophotographic photosensitive member) as a first image bearing member for bearing a toner image. The photosensitive drum 1 is rotationally driven at a predetermined peripheral speed in an arrow R1 direction (clockwise direction). A surface of the rotating photosensitive drum 1 is electrically charged uniformly to a predetermined polarity (negative in this embodiment) and a predetermined potential by the charging roller 2 which is a roller-type charging member as a charging means. The charged surface of the photosensitive drum 1 is subjected to scanning exposure to light depending on image data (image information signal) by the exposure device (laser scanner) 3 as an exposure means, so that an electrostatic image (electrostatic latent image) depending on the image data is formed on the photosensitive drum 1. The electrostatic image formed on the photosensitive drum 1 is developed (visualized) by supplying toner as a developer by the developing device 4 as a developing means, so that a toner image (developer image) depending on the image data is formed on the photosensitive drum 1. In this embodiment, the toner charged to the same polarity as a charge polarity of the photosensitive drum 1 is deposited on an exposed portion (image portion) of the photosensitive drum 1 where an absolute value of the potential is lowered by exposing to light the surface of the photosensitive drum 1 after the photosensitive drum 1 is uniformly charged.

As a second image bearing member for bearing the toner image, an intermediary transfer belt 7 which is constituted by a rotatable endless belt and which is an intermediary transfer member is provided so as to oppose the four photosensitive drums 1. The intermediary transfer belt 7 is extended around and stretched by a plurality of stretching rollers (supporting rollers) including a driving roller 71, a tension roller 72, first and second idler rollers 73 and 74 and a secondary transfer opposite roller 75. The intermediary transfer belt 7 is driven and circulated (rotationally driven) in an arrow R2 direction (counterclockwise direction) in FIG. 1 by the driving roller 71. The intermediary transfer belt 7 is constituted by a film-shaped endless belt formed of a material including various resin materials, such as polyimide and polyamide, compounds thereof, or various rubbers and including an antistatic agent such as carbon black contained in an appropriate amount in the resin material or the like, for example. The intermediary transfer belt 7 is $5\times10^{10}$-$1\times10^{12}$ Ω/square in surface resistivity in an initial stage (during a start of use) and is about 40-60 mm in thickness, for example. The driving roller 71 is driven by a motor excellent in constant-speed property and circulates and moves (rotates) the intermediary transfer belt 7. The tension roller 72 imparts a certain tension to the intermediary transfer belt 7. The first and second idler rollers 73 and 74 support the intermediary transfer belt 7 extending along an arrangement direction of the photosensitive drums 1Y, 1M, 1C and 1K. The secondary transfer opposite roller 75 functions as an opposing member (opposing electrode) of a secondary transfer roller 8 described later. In this embodiment, the intermediary transfer belt 7 is rotationally driven at a peripheral speed of 200 mm/s. Further in this embodiment, the tension of the intermediary transfer belt 7 relative to the tension roller 72 is about 5 kgf. On the inner peripheral surface side of the intermediary transfer belt 7, the primary transfer rollers 5 which are roller-type primary transfer members as primary transfer means are disposed correspondingly to the respective photosensitive drums 1. The primary transfer roller 5 is urged toward an associated photosensitive drum 1 side through the intermediary transfer belt 7, whereby a primary transfer portion (primary transfer nip) T1 where the photosensitive drum 1 and the intermediary transfer belt 7 contact each other is formed.

The toner image formed on the photosensitive drum 1 as described above is primary-transferred onto the rotating intermediary transfer belt 7 at the primary transfer portion T1 by the action of the primary transfer roller 5. During the primary transfer step, to the primary transfer roller 5, a primary transfer bias (primary transfer voltage) which is a DC voltage of an opposite polarity (positive in this embodiment) to a normal charge polarity of the toner (charge polarity of the toner during development) is applied by a primary transfer voltage source D1. For example, during full-color image formation, the color toner images of Y, M, C and K formed on the respective photosensitive drums 1 are successively primary-transferred superposedly onto the intermediary transfer belt 7 at the respective primary transfer portions T1.

On an outer peripheral surface side of the intermediary transfer belt 7, at a position opposing the secondary transfer opposite roller 75, the secondary transfer roller 8 which is a roller-type secondary transfer member as a secondary transfer means is provided. The secondary transfer roller 8 is urged toward the secondary transfer opposite roller 75 through the intermediary transfer belt 7 and forms a secondary transfer portion (secondary transfer nip T2 where the intermediary transfer belt 7 and the secondary transfer roller 8 contact each other. The toner images formed on the intermediary transfer belt 7 as described above are secondary-transferred onto a recording material (transfer material, sheet) P such as paper sandwiched and fed by the intermediary transfer belt 7 and the secondary transfer roller 8 at the secondary transfer portion T2 by the action of the secondary transfer roller 8. During the secondary transfer step, to the secondary transfer roller 8, a secondary transfer bias which is a DC voltage of the opposite polarity to the normal charge polarity of the toner is applied by a secondary transfer voltage source D2. The secondary transfer opposite roller 75 is electrically grounded (i.e., connected to the ground). Incidentally, a constitution in which a roller corresponding the secondary transfer opposite roller 75 in this embodiment is used as a transfer member and to this roller, a secondary transfer bias of the same polarity as the normal charge polarity of the toner is applied and in which a roller corresponding to the secondary transfer roller 8 in this embodiment is used as an opposite member and is electrically grounded may also be employed.

In this embodiment, the secondary transfer roller 8 is constituted by providing, as an elastic layer, a 6 mm-thick sponge layer of electroconductive EPDM rubber around a core metal (base material) of 12 mm in outer diameter. In this embodiment, an ion-conductive agent is contained in a material of the elastic layer of the secondary transfer roller 8, so that the secondary transfer roller 8 possesses an ion-conductive property. An electric resistance value of the secondary transfer roller 8 was about $10^8\Omega$ when an applied voltage value is 2000 V.

The recording material P is fed to the secondary transfer portion T2 by a recording material supplying device 10 as a recording material supplying portion. The recording material supplying device 10 includes a recording material accommodating portion (cassette, tray or the like) 11 for accommodating the recording material P, a pick-up roller 12 for feeding the recording material P one by one from the recording material accommodating portion 11 at predetermined timing, a feeding roller pair 13 for feeding the fed recording material P, and the like. The recording material P fed by the feeding roller pair 13 is fed toward the secondary transfer portion T2 by being timed to the toner images on the intermediary transfer belt 7 by a registration roller pair 50 as a registration correcting portion.

The recording material P on which the toner images are transferred is fed toward a fixing device 9 as a fixing means. The fixing device 9 heats and presses the recording material P carrying thereon unfixed toner images, and thus fixes (melt-fixes) the toner images on the recording material P. In the case where an image forming mode is a one-side mode (one-side printing) in which the image is formed on only one side (surface) of the recording material P, the recording material P on which the toner images are fixed on one side (surface) thereof is discharged (outputted) to an outside of an apparatus main assembly of the image forming apparatus 100 by a discharging roller pair 30 as a discharging portion.

In the case where the image forming mode is an automatic double-side mode (automatic double-side printing) in which the images are formed on double (both) sides (surfaces) of the recording material P, the recording material P on which the image is formed (the toner image is fixed) on a first side (surface) is fed again to the secondary transfer portion T2 by a double-side feeding device 40. In the case of the automatic double-side mode, the discharging roller pair 30 is reversed at predetermined timing before the recording material P on which the image is formed on the first side is discharged to the outside of the image forming apparatus. As a result, the recording material P is guided into a reverse path (double-side feeding path) 41 of the double-side feeding device 40. The recording material P guided into the reverse path 41 is fed toward the registration roller pair 50 by a re-feeding roller pair 42. Similarly as in the case of the image formation on the first side, this recording material P is fed to the secondary transfer portion T2 by being timed to the toner images on the intermediary transfer belt 7 by the registration roller pair 50, so that the toner images are secondary transferred onto a second side (surface) opposite from the first side. The recording material P on which the toner images are transferred on the second side is discharged to the outside of the image forming apparatus by the discharging roller pair 30 after the toner images are fixed on the second side of the recording material P by the fixing device 9.

Further, toner (primary transfer residual toner) remaining on the photosensitive drum 1 without being transferred onto the intermediary transfer belt 7 during the primary transfer step is removed and collected from the photosensitive drum 1 by a drum cleaning device 6 as a photosensitive member cleaning means. Further, on the outer peripheral surface side of the intermediary transfer belt 7, at a position opposing the driving roller 71, a belt cleaning device 76 as an intermediary transfer member cleaning means is provided. Toner (secondary transfer residual toner) remaining on the intermediary transfer belt 7 without being transferred onto the recording material P during the secondary transfer step, and paper powder are removed and collected from the surface of the intermediary transfer belt 7 by the belt cleaning device 76.

2. Control Mode

Figure 2:
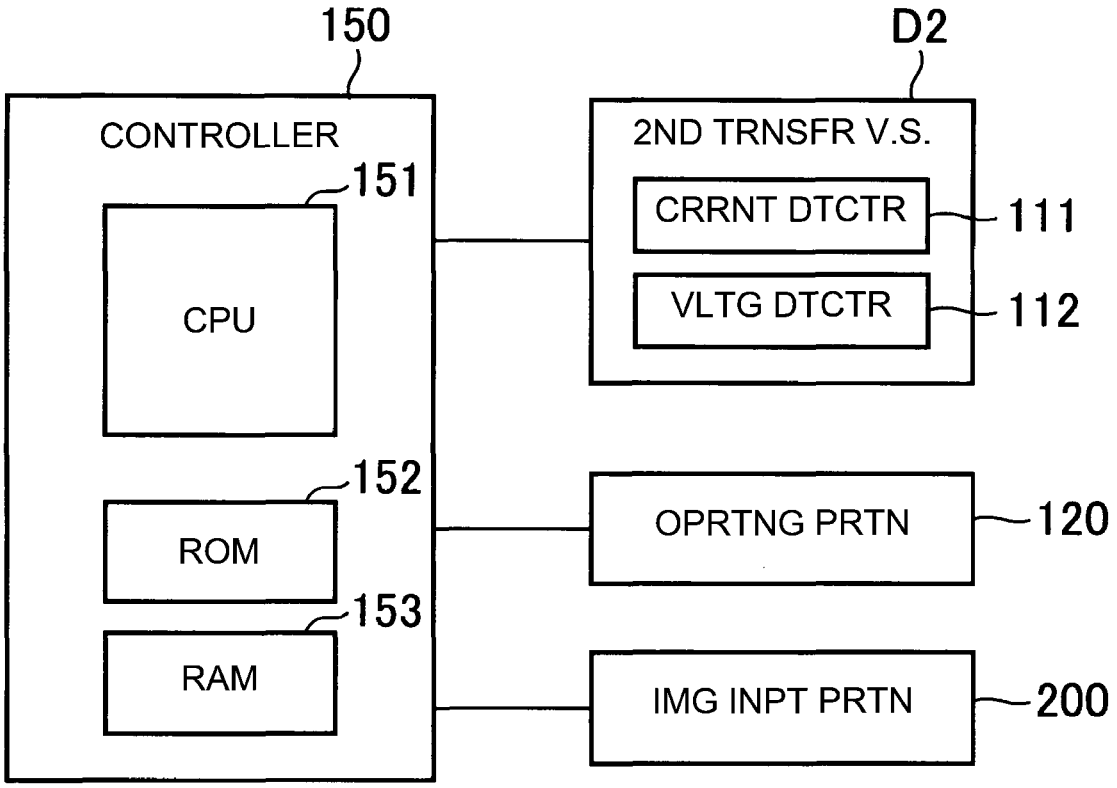
FIG. 2 is a schematic control block diagram showing a control mode of a principal part of the image forming apparatus.

FIG. 2 is a schematic black diagram showing a control mode of a principal part of the image forming apparatus 100 in this embodiment. A controller 150 as a control means is constituted by including a CPU 151 as an arithmetic and control means which is a dominant element for performing processing, and memories (storing media) such as a ROM 152 and a RAM 153 which are used as storing means. In the ROM 152, a control program and a data table (set values necessary for various pieces of control) acquired in advance, and the like are stored and are read by the CPU 151 has needed. In the RAM 153, information (various data such as print number of sheets changing every job) inputted to the controller 150, detected information, a calculation result and the like are temporarily stored and are used in various pieces of control. The CPU 151 and the memories such as the ROM 152 and the RAM 153 are capable of transferring and reading the data therebetween.

To the controller 150, the secondary transfer voltage source D2 as applying means is connected. In this embodiment, the secondary transfer voltage source D2 is provided with a current detecting circuit 111 as a current detecting means for detecting a current flowing through the secondary transfer roller 8 (i.e., the secondary transfer voltage source D2) when a bias is applied to the secondary transfer roller 8 by the secondary transfer voltage source D2. Further, the controller 150 is capable of carrying out constant current control of the bias applied from the secondary transfer voltage source D2 to the secondary transfer roller 8 by controlling a voltage outputted from the secondary transfer voltage source D2 so that a current value detected by the current detecting circuit 111 (described later) is a predetermined current value. Further, in this embodiment, the secondary transfer voltage source D2 is provided with a voltage detecting circuit 112 as a voltage detecting means for detecting a voltage outputted when a bias is applied to the secondary transfer roller 8 by the secondary transfer voltage source D2. Further, the controller 150 is capable of carrying out constant voltage control of the bias applied from the secondary transfer voltage source D2 to the secondary transfer roller 8 by controlling a voltage outputted from the secondary transfer voltage source D2 so that a voltage value detected by the voltage detecting circuit 112 (described later) is a predetermined voltage value.

Further, to the controller 150, an operating portion (operating panel) 120 is connected. The operating portion 120 has functions of a display portion as a display means for displaying information by the control of the controller 150 and an input portion as an input means for inputting the information to the controller 150. In this embodiment, an operator such as a user or a service person can select a kind of the recording material P used for image formation, an image forming mode (one-side mode, automatic double-side mode) and the like through the operating portion 120. Further, to the controller 150, an image reading device (not shown) and an external device (not shown) such as a personal computer are connected. The controller 150 is capable of causing the image forming apparatus 100 to execute an image forming operation by controlling respective portions of the image forming apparatus 100, depending on information on an image forming condition inputted from the operating portion 120 and image data inputted from the image reading device. Further, the controller 150 is capable of causing the image forming apparatus 100 to execute the image forming operation by controlling the respective portions of the image forming apparatus 100, depending on information (a control instruction such as image data or the image forming condition) of a job inputted from the external device such as the personal computer. The information on the image forming condition includes data for designating the kind of the recording material P used in the image formation, data for designating the image forming mode (one-side mode, automatic double-side mode) and the like. In this embodiment, the above-described image reading device and external device constitute an image input portion 200 for inputting image information to the controller 150. Incidentally, the kind of the recording material P includes attributes based on general features such as plain paper, thick paper, thin paper, glossy paper and coated paper and includes arbitrary information capable of discriminating the recording material P, such as a maker, a brand, a product number, a basis weight, a thickness and a size.

Here, the image forming apparatus 100 executes a job (printing operation), which is a series of operations started by a single start instruction (print instruction) and in which the image is formed and outputted on a single recording material P or a plurality of recording materials P. The job includes an image forming step, a pre-rotation step, a sheet (paper) interval step in the case where the images are formed on the plurality of recording materials P, and a post-rotation step, in general. The image forming step is performed in a period in which formation of an electrostatic image for the image actually formed and outputted on the recording material P, formation of the toner image, primary transfer of the toner image and secondary transfer of the toner image are carried out, in general, and during image formation (image forming period) refers to this period. Specifically, timing during the image formation is different among positions where the respective steps of the formation of the electrostatic image, the toner image formation, the primary transfer of the toner image and the secondary transfer of the toner image are performed. The pre-rotation step is performed in a period in which a preparatory operation, before the image forming step, from an input of the start instruction until the image is started to be actually formed, is performed. The sheet interval step is performed in a period corresponding to an interval between a recording material P and a subsequent recording material P when the images are continuously formed on a plurality of recording materials P (continuous image formation). The post-rotation step is performed in a period in which a post-operation (preparatory operation) after the image forming step is performed. During non-image formation (non-image formation period) is a period other than the period of the image formation (during image formation) and includes the periods of the pre-rotation step, the sheet interval step, the post-rotation step and further includes a period of a pre-multi-rotation step which is a preparatory operation during turning-on of a main switch (voltage source) of the image forming apparatus 100 or during restoration from a sleep state. In this embodiment, during the non-image formation control (adjustment) of the secondary transfer bias is carried out.

3. Divided Video Counts

In this embodiment, it becomes possible to acquire an integrated value of a video count in an arbitrary region of an image forming region with respect to a sub-scan direction (herein, this region is also referred to as a "video count acquiring region"). Particularly, in this embodiment, an integrated value of an output level (density level) of image data for each pixel is acquired by the video count, so that it becomes possible to acquire information on an image ratio corresponding to a toner application amount in the arbitrary region. Incidentally, a "main scan direction" is a direction substantially perpendicular to a surface movement direction (feeding direction of the recording material P) of the photosensitive drum 1 or the intermediary transfer belt 7. Further, the "sub-scan direction" is a direction (substantially parallel to the recording material P feeding direction) substantially perpendicular to the main scan direction. Further, the "image forming region" is a region which is set depending on a size of the recording material P used in the image formation and in which an image, to be formed on a single recording material P, is capable of being formed on the photosensitive drum 1, the intermediary transfer belt 7 or the recording material P. Further, the toner application amount is a weight of the toner per unit area (mg/cm$^2$).

Figure 3:
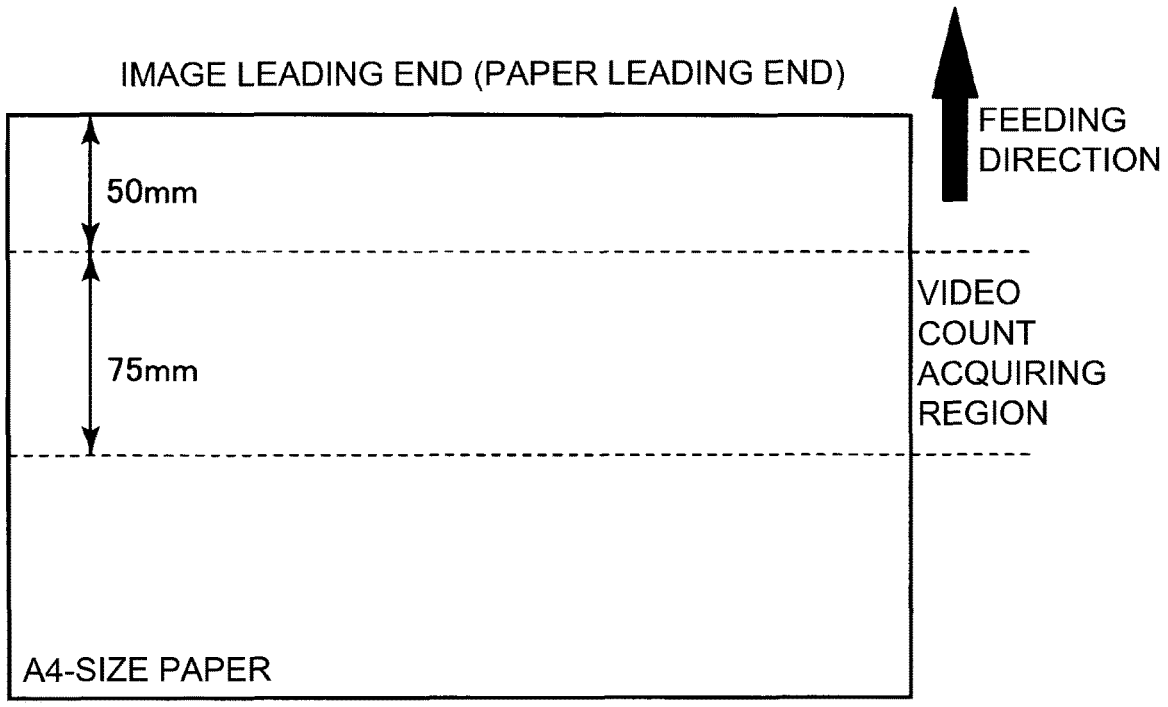
FIG. 3 is a schematic view for illustrating a video count acquiring region.

FIG. 3 is a schematic view showing the video count acquiring region in the case where an image is formed on an A4-size (short edge feeding) recording material P in this embodiment. Incidentally, for simplicity, in this embodiment, the image forming region and the size of the recording material P are substantially the same. Further, the surface movement direction of the photosensitive drum 1, the intermediary transfer belt 7 or the recording material P is also referred simply to as the "feeding direction".

As shown in FIG. 3, in this embodiment, with respect to the feeding direction, a region from a position of 50 mm from a leading end of the image forming region, toward a trailing end side, to a position of 75 mm from the first position toward the trailing end side (i.e., to a position of 125 mm from the leading end) is the video count acquiring region. As specifically described later, in this embodiment, a length (75 mm) of the video count acquiring region with respect to the feeding direction is substantially equal to an outer peripheral (circumferential) length of the secondary transfer roller 8.

Incidentally, in this embodiment, between when the toner image is formed on a first surface (side) of the recording material P and when the toner image is formed on a second surface side, the leading end and the trailing end, with respect to the feeding direction, of the recording material P during passing through the secondary transfer portion T2 are reversed. The position of the video count acquiring region is a position on a surface of the recording material, being passed through the secondary transfer portion T2, on which the toner image is to be transferred. Further, the position of the video count acquiring region may only be required to be a region which passes through the secondary transfer portion T2 during detection of the secondary transfer current as described later, and absolute positions on respective recording materials P may also be different from each other. Further, for example, a constitution in which a video count value for each of divided regions obtained by dividing the image forming region into a plurality of regions for each predetermined length unit with respect to the sub-scan direction (and further with respect to the main scan direction) is capable of being acquired may also be employed. In this case, the video count value in the video count acquiring region may only be required to be acquired by performing a counting process in which video count values of the divided regions included in the region passing through the secondary transfer portion T2 during detection of the secondary transfer current are acquired.

A process flow of the image data inputted to the CPU 151 functioning as a video count means will be described. The image data inputted from the image input portion 200 to the CPU 151 of the controller 150 is converted from luminance values into density values (CMYK in this embodiment) by the CPU 151. The image data converted into CMYK data which are the density values are integrated as data for each pixel and each color component. The CPU 151 includes data, by which each color component data of the image data per one pixel is represented by a plurality of bits, in a predetermined unit for each color component of each pixel. In each color component having gradation levels of 8 bits (0-255), in the case where Y data of a first pixel is a value of "100" and Y data of a second pixel is a value of "50", an integrated value of the first pixel and the second pixel is "150". In this embodiment, the video count value is represented by an image ratio (0-100%) which is a proportion of a video count value to a maximum video count value which is taken as 100% (in the case of a single color) when an entirety of pixel components in the video count acquiring region is 255. Incidentally, there is a color represented by color mixture of YMCK, and in this embodiment, a maximum of the video count in that case is 200%. Incidentally, in the case of image data of an A4 size and 600 dpi, the image data of the color components corresponding to 7015 pixels (main scan direction)×4962 pixels (sub-scan direction), i.e., 34808430 pixels in total, are integrated per (one) page.

4. Secondary Transfer ATVC Control

In this embodiment, the secondary transfer bias is determined (controlled, adjusted) by ATVC (auto transfer voltage control) carried out during a pre-rotation step for each job. By carrying out the ATVC control, even in the case where the electric resistance of the secondary transfer roller 8 changes, it becomes possible to apply an optimum secondary transfer bias.

Figure 4:
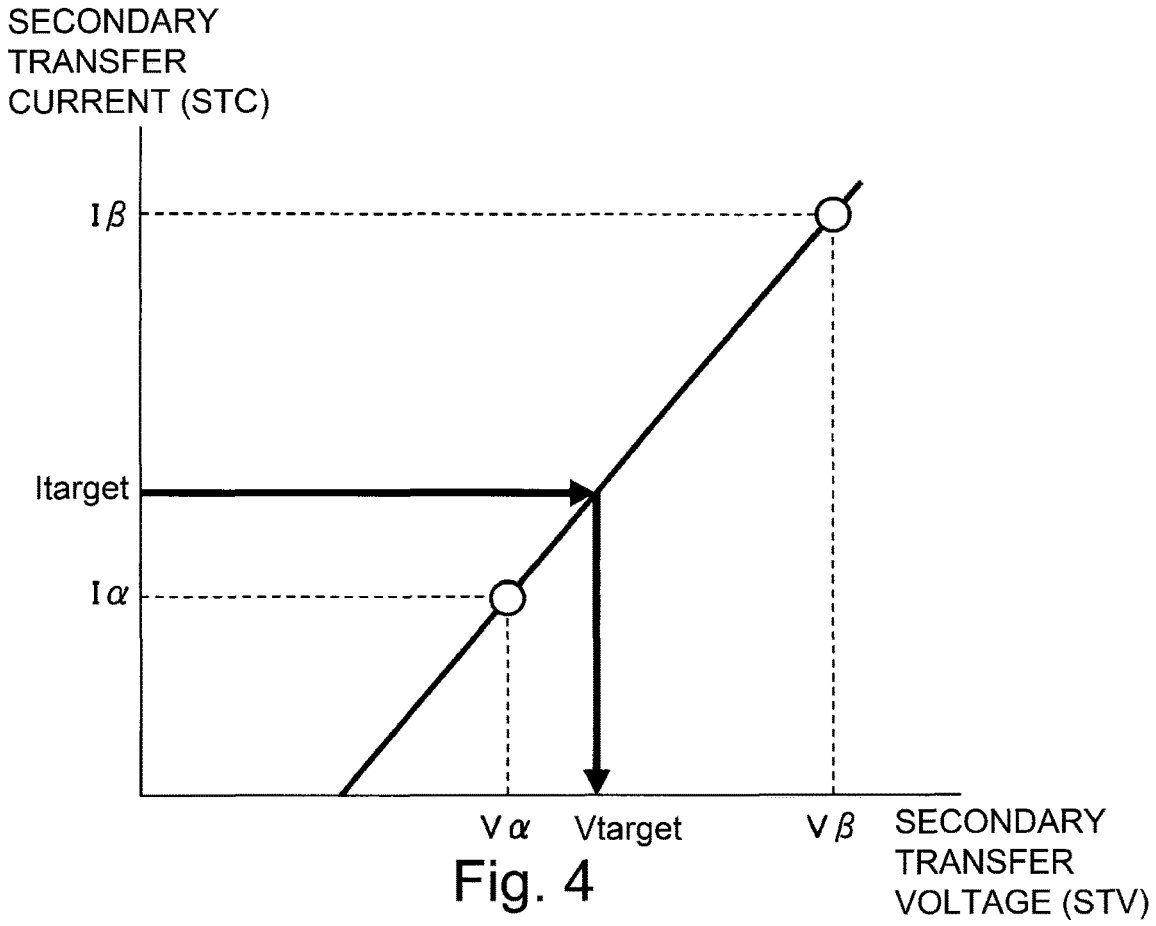
FIG. 4 is a graph for illustrating secondary transfer ATVC.

The ATVC in this embodiment will be further described. FIG. 4 is a schematic graph showing a relationship between an applied voltage value and a detected current value (voltage-current characteristic) which are measured in the ATVC. In this embodiment, the controller 150 calculates a set voltage value (target voltage value) Vout of the secondary transfer bias in the following manner. The controller 150 causes the voltage source to apply biases of voltage values $V\alpha$ and $V\beta$ which are a plurality of levels to the secondary transfer roller 8, and causes the current detecting circuit to perform an operation of detecting values $I\alpha$ and $I\beta$ of currents flowing at that time. Then, the controller 150 acquires a voltage value Vtarget corresponding to a target current value Itarget which is a predetermined secondary transfer current value necessary for secondary transfer, from the relationship between the applied voltage value and the detected current value (voltage-current characteristic) by an interpolation operation. This voltage value corresponds to a secondary transfer portion sharing voltage. Incidentally, the target current value Itarget is set in advance for each condition such as an environment and is stored as a data table or the like in the ROM 152. The controller 150 selects and uses the target current value Itarget depending on a condition when the ATVC is carried out. Further, the controller 150 acquires a set voltage value Vout of the secondary transfer bias by adding a predetermined recording material sharing voltage Vp depending on an electric resistance of the recording material to the acquired secondary transfer portion sharing voltage Vtarget. Incidentally, the recording material sharing voltage Vp is set in advance for each condition such as a kind (and further the environment) of the recording material P, and is stored as a data table or the like in the ROM 152. The controller 150 selects and uses the recording material sharing voltage Vp depending on the condition such as the kind of the recording material P inputted from the operating portion 120 or the external device. Then, during image formation (during secondary transfer), the controller 150 causes the secondary transfer voltage source D2 to apply a secondary transfer bias, subjected to constant voltage control with the acquired set voltage value Vout, to the secondary transfer roller 8. Incidentally, secondary transfer bias correction control in which the set voltage value Vout is corrected during continuous image formation will be described later.

In this embodiment, as an example, in the case where the image is formed on plain paper of 75 gsm in basis weight, the following setting is made. First, the target current value of the secondary transfer is set at 40 μA. Further, as regards the recording material sharing voltage Vp, a recording material sharing voltage Vp1 on the first surface (side) is set at 400 V, and a recording material sharing voltage Vp2 on the second surface (side) is set at 800 V. Incidentally, optimum values of the target current value and the recording material sharing voltages are not limited to the above-described values, but change depending on the charge amount of the toner used, an assumed electric resistance of the recording material, and the like.

Incidentally, a method itself in which an initial set voltage value of the secondary transfer bias is determined is not limited to the above-described method. For example, the number of the levels of the applied voltage value in the ATVC is not limited to two levels but may also be three levels or more. Further, the acquired voltage-current characteristic is not limited to a linear relationship but may also be a curvilinear relationship. Further, a generated voltage value when a bias subjected to constant current control with a predetermined current value is applied, or a voltage value obtained by subjecting this generated voltage value to predetermined arithmetic processing may also be used as the secondary transfer portion sharing voltage.

5. Secondary Transfer Bias Correction Control

In this embodiment, during continuous image formation, secondary transfer bias correction control in which the set voltage value Vout of the secondary transfer bias determined by the above-described ATVC is corrected is carried out. That is, in the case where the continuous image formation is carried out under application of the secondary transfer bias subjected to constant voltage control with the above-described set voltage value Vout, a deviation in secondary transfer current value during passing of the recording material P through the secondary transfer portion T2 occurs in some instances between a first sheet and a second sheet or a later sheet. For that reason, in order to correct this deviation in secondary transfer current value, the secondary transfer bias correction control is carried out.

Parts (a) and (b) of FIG. 5 are graphs showing changes of the secondary transfer voltage value and the secondary transfer current value, respectively, from an initial stage (first sheet) when the recording material P passes through the secondary transfer portion T2 in the case where the following continuous image formation is carried out in the image forming apparatus 100 of this embodiment. The continuous image formation was carried out by an operation in an automatic double-side (printing) mode in which the secondary transfer bias subjected to constant voltage control with the set voltage value Vout determined by the ATVC is applied and in which as the recording material P, A4-size plain paper (general-purpose office sheet) is used. Incidentally, on both the first surface and the second surface of the recording material P, an image with an image ratio of 0% (so-called solid white image) was formed.

As is understood from parts (a) and (b) of FIG. 5, as the secondary transfer current value when the first recording material P passes through the secondary transfer portion T2, 40 μA which is the above-described target current value is obtained for both the first surface and the second surface. However, with an increasing number of sheets subjected to the image formation, the secondary transfer current value when the recording material P passes through the secondary transfer portion T2 gradually increases for both the first surface and the second surface. Further, the secondary transfer current value when the recording material P passes through the secondary transfer portion T2 is 45 μA for the first surface and 50 μA for the second surface of a 50-th sheet, 50 μA for the first surface and 60 μA for the second surface of a 100-th sheet, and 60 μA for the first surface and 80 μA for the second surface of a 200-th sheet.

The reason why the secondary transfer current value when the recording material P passes through the secondary transfer portion T2 increases as described above in the case where the continuous image formation is carried out with constant set voltage value Vout of the secondary transfer bias is as follows. During continuous image formation, the recording material (paper) P passed through the secondary transfer portion T2 is heated when it passes through the fixing device 9, and water content contained in the recording material P is dissipated. The dissipated water content stagnates in the image forming apparatus 100, so that an ambient water content (amount) in the image forming apparatus 100 is increased by the stagnation of the water content. In this state, the recording material P fed in the image forming apparatus 100 is conveyed in the image forming apparatus 100 with a high ambient water content, so that a resultant water content increases. That is, the recording materials P fed as the second sheet and later sheets successively in the image forming apparatus 100 during continuous image formation are lower in electric resistance than the first recording material P. For that reason, as regards the second recording material P and later recording materials P, when the secondary transfer bias subjected to the constant voltage control with the above-described set voltage value Vout is applied, the secondary transfer current value becomes higher relative to the case of the first recording material P. Particularly, the recording material P passing through the secondary transfer portion T2 for image formation on the second surface is longer in time of a stay in the image forming apparatus 100 than the recording material P passing through the secondary transfer portion T2 for image formation on the first surface, and therefore, the above-described increase in secondary transfer current value is also more conspicuous.

Thus, when the secondary transfer current value when the recording material P passes through the secondary transfer portion T2 gradually increases during continuous image formation, a transfer property of the toner image onto the recording material P at the secondary transfer portion T2 gradually lowers. That is, relative to a density of an output image on the first sheet, a density of an output image on the second sheet and later sheets gradually lowers.

Therefore, in this embodiment, during continuous image formation, the secondary transfer bias correction control for correcting the secondary transfer bias set voltage value Vout determined by the above-described ATVC is carried out, so that the above-described increase in secondary transfer current value is suppressed. In this embodiment, the secondary transfer bias correction control during continuous image formation is roughly carried out in the following manner. Here, the case where the continuous image formation is carried out by the operation in the automatic double-side mode will be described as an example.

First, for each of the first surface and the second surface of the first recording material P, the secondary transfer current value when the recording material P passes through the secondary transfer portion T2 is detected, and detection results thereof are current values Ity (first surface) and Itr (second surface) which constitute a basis (reference values)

of the correction control. Then, for each of the first surface and the second surface of the second recording material P, secondary transfer current values Imon_2 (first surface) and Imon_2 (second surface) when the recording material P passes through the secondary transfer portion T2 are detected. Then, Itr (first surface) and Imon_2 (first surface) are compared with each other, and Itr (second surface) and Imon_2 (second surface) are compared with each other. As a result, in the case where Itr (first surface)<Imon_2 (first surface) and Itr (second surface)<Imon_2 (second surface) are satisfied, the secondary transfer bias set voltage value Vout for each of the first surface and the second surface of a third recording material P is corrected. As a result, the secondary transfer current value when the third recording material P passes through the secondary transfer portion T2 is made close to Itr (first surface) for the first surface and to Itr (second surface) for the second surface.

FIG. 6 is a graph for illustrating a correcting method of the set voltage value Vout in the secondary transfer bias correction control in this embodiment. In the case of Itr (first surface)<Imon_2 (first surface), a deviation ΔI (first surface) of the secondary transfer current value for the first surface is acquired by the following formula: ΔI (first surface) =Imon_2 (first surface)−Itr (first surface). Similarly, in the case of Itr (second surface)<Imon_2 (second surface), a deviation ΔI (second surface) of the secondary transfer current value for the second surface is acquired by the following formula: ΔI (second surface)=Imon_2 (second surface)−Itr (second surface). Further, a correction voltage value ΔV for correcting the deviation ΔI of the secondary transfer current value is calculated using a slope (Iβ−Iα)/(VB−Vα) of the voltage-current characteristic (FIG. 4) acquired in the ATVC. Then, values obtained by subtracting the calculated correction voltage value from secondary transfer bias set voltage values Vout_1 (first surface) (=Vout_2 (first surface)) and Vout_1 (second side) (=Vout_2 (second surface)) for the first surface and the second surface, respectively, are used as secondary transfer bias set voltage values Vout_3 (first surface) and Vout_3 (second surface) for the third sheet.

Also as regards the third and later sheets, detection of the secondary transfer current value and correction of the secondary transfer bias set voltage value are carried out similarly in the above-described manners. That is, the secondary transfer current value when the third recording material P (first surface, second surface) passes through the secondary transfer portion T2 is detected. Then, a secondary transfer bias set voltage value when a fourth recording material (first surface, second surface) passes through the secondary transfer portion T2 is corrected so as to reduce a difference in secondary transfer current value between the first sheet and the third sheet.

Incidentally, in this embodiment, the set voltage value of the secondary transfer bias for each of the third and later recording materials P during continuous image formation can be corrected, but the present invention is not limited thereto. A constitution in which during continuous image formation, on the basis of a detection result of the secondary transfer current value when a certain recording material P passes through the secondary transfer portion T2, a set voltage value of the secondary transfer bias when a subsequent recording material P to the certain recording material P passes through the secondary transfer portion T2 can be corrected may only be required to be employed. For example, a constitution in which set voltage values of the secondary transfer bias for subsequent recording materials P are corrected successively with an interval corresponding to a predetermined number of sheets may also be employed. Further, in this embodiment, as the basis of the secondary transfer bias correction control, the detection result of the secondary transfer current value when the first recording material passes through the secondary transfer portion T2 was used, but the basis is not limited thereto and may also be a predetermined value. As this predetermined value, it is possible to cite a target current value in the ATVC or a current value obtained by subjecting this target current value to a predetermined arithmetic operation, or the like value, for example. Further, a detection result of the secondary transfer current value when a recording material P which is an arbitrary number-th sheet passes through the secondary transfer portion T2 may also be used as the basis of the secondary transfer bias correction control.

6. Relationship Between Video Count Value and Secondary Transfer Current Value

In this embodiment, as described above, during continuous image formation, the secondary transfer bias correction control in which the set voltage value of the secondary transfer bias is corrected on the basis of the detection result of the secondary transfer current value when the recording material P passes through the secondary transfer portion T2 is carried out. Further, in this embodiment, during this secondary transfer bias correction control, the detection result of the secondary transfer current value is corrected on the basis of a video count value in a region of the recording material P in which detection of the secondary transfer current value is carried out. As a result, in this embodiment, the influence of a deviation of the detection result of the secondary transfer current value due to a difference in toner amount on the recording material P is suppressed, so that the set value of the secondary transfer bias can be corrected further appropriately during continuous image formation. In the following, description will be specifically made.

In this embodiment, as described above, the increase in secondary transfer current value during continuous image formation is suppressed by the secondary transfer bias correction control. At this time, in this embodiment, as the above-described Itv (first surface), Itr (second surface) and Imon (for example, Imon_2 (first surface), Imon_2 (second surface) relating to the second sheet), the following values are used, respectively. Values obtained by correcting actually detected current values Itr_d (first surface), Itr_d (second surface) and Imon_d (for example, Imon_2_*d* (first surface), Imon_2_*d* (second surface) relating to the second sheet) depending on a video count value relating to a region of the recording material P passing through the secondary transfer portion T2 in a detection period thereof are used. That is, in this embodiment, a detecting region of the recording material P passing through the secondary transfer portion T2 in the detection period, of a period in which the recording material passes through the secondary transfer portion T2, in which detection of the secondary transfer current is carried out is used as the above-described video count acquiring region. Then, a video count value relating to the video count acquiring region is acquired, and on the basis of this video count value, the detection result of the secondary transfer current value in the detection period is corrected. This is because depending on the toner amount on the recording material P, the secondary transfer current value when the recording material P passes through the secondary transfer portion T2 is different. Incidentally, as the detection result of the secondary transfer current in the above-described detection period, a representative value such as an average of the secondary transfer current values detected in the detection period can be used.

FIG. 7 is a graph showing a relationship between the video count value (image ratio) correlating with the toner amount on the recording material P and the secondary transfer current value detected when the recording material P passes through the secondary transfer portion T2. As the recording material P, plain paper of 75 gsm in basis weight was used. As is understood from FIG. 7, in the case where the video count value is 0%, the secondary transfer current value is 40 μA which is a target current value, but in the case where the video count value is 100%, the secondary transfer current value is 35.3 μA, and in the case where the video count value is 200%, the secondary transfer current value is 31 μA. That is, with an increasing video count value (toner amount), the secondary transfer current value (absolute value) is detected as a smaller value. This is because the toner on the recording material P acts as an electrical resistor, or the like. That is, it is understood that in order to more accurately detect information on a change in secondary transfer current value including information on a change in electric resistance of the recording material P, there is a need to correct a detection result of the secondary transfer current value depending on the toner amount (video count value) on the recording material P.

Table 1 below is a data table showing correction efficiency set in advance depending on the video count value, for correcting the detection result of the secondary transfer current value. For example, in the case where the video count value is 0%, the correction efficiency is 1, in the case where the video count value is 100%, the correction efficiency is 1.15, and in the case where the video count value is 200%, the correction efficiency is 1.3. That is, with an increasing video count value (toner amount), the correction efficiency is larger and thus the secondary transfer current value (absolute value) is corrected to a lager value. The data table as shown in Table 1 has been set in advance and has been stored in the ROM 152.

TABLE 1

| Video count value (VC) | Current correction efficiency |
|---|---|
| 0% | 1 |
| 0% < VC ≤ 30% | 1.05 |
| 30% < VC ≤ 65% | 1.1 |
| 65% < VC ≤ 100% | 1.15 |
| 100% < VC ≤ 130% | 1.2 |
| 130% < VC ≤ 165% | 1.25 |
| 165% < VC ≤ 200% | 1.3 |

In this embodiment, the controller 150 multiplies actually detected secondary transfer current values Itr_d (first surface), Ttr_d (second surface) and Imon_d by the above correction efficiency. As a result, Itr (first surface), Itr (second surface) and Imon used for acquiring a correction voltage value ΔV in the above-described secondary transfer bias correction control are calculated.

Further, in this embodiment, detection of the secondary transfer current is carried out in a period corresponding to one full circumference (turn) of the secondary transfer roller 8, i.e., in a period in which a region, on the recording material P, of 75 mm with respect to the feeding direction which is substantially equal to an outer peripheral length of the secondary transfer roller 8 passes through the secondary transfer portion T2. This is for the purpose of smoothing electric resistance non-uniformity of the secondary transfer roller 8 with respect to a rotational direction. For this purpose, in this embodiment, the video count value relating to the video count acquiring region of 75 Mm with respect to the feeding direction as shown in FIG. 3 is acquired. Incidentally, the detection period in which the secondary transfer current value is detected is not limited to the period corresponding to the one full circumference (turn) of the secondary transfer roller 8. This period may preferably be a period corresponding to a substantially integral multiple of one full circumference (turn) of the secondary transfer roller 8 from the viewpoint of smoothing of the electric resistance non-uniformity. That is, a length of the video count acquiring region of the recording material P with respect to the feeding direction may preferably be a substantially integral multiple of the outer peripheral length of the secondary transfer roller 8. However, typically, this period is shorter than a period in which an image forming region of a single recording material P passes through the secondary transfer portion T2 (that is, the video count acquiring region is shorter than a length of the image forming region of the single recording material P with respect to the feeding direction.

7. Control Flow

FIG. 8 is a flowchart of an operation of a job of continuous image formation in this embodiment. Here, the case where the continuous image formation is carried out will be described as an example.

When the job of the continuous image formation is started by an instruction from the operating portion 120 or the like (S101), the controller 150 carries out the ATVC and determines set voltage values Vout_1 (first surface) and Vout_1 (second surface) of the secondary transfer bias (S102). Then, the controller 150 detects secondary transfer current values Itr_d (first surface) and Itr_d (second surface) when the first recording material P passes through the secondary transfer portion T2 (S103). Then, the controller 150 corrects the Itr_d (first surface) and Itr_d (second surface) on the basis of the video count value of the video count acquiring region (detection region of the secondary transfer current value) of the first recording material P, and thus acquires the secondary transfer current values Itr (first surface) and Itr_d (second surface) (S104). That is, in this embodiment, the controller 150 not only acquires the video count value of the video count acquiring region of the first recording material P but also selects correction efficiency depending on the acquired video count value by making reference to the data table as shown in Table 1. Then, the controller 150 corrects the Itr_d (first surface) and Itr_d (second surface) by using the selected correction efficiency, and thus acquires the secondary transfer current values Itr (first surface) and Itr (second surface). Then, the controller 150 sets N=1 (S105), and detects secondary transfer current values Imon_N+1_d (first surface) and Imon_N+1_d (second surface) when an (N+1)-th (second at first) recording material P passes through the secondary transfer portion T2 (S106). Incidentally, in the case of N=1, secondary transfer bias set voltage values Vout_N+2 (first surface) and Vout_N+2 (second surface) (i.e., Vout_2 (first surface) and Vout_2 (second surface)) when the (N+1)-th (i.e., second) recording material P passes through the secondary transfer portion T2 are the same as the set voltage values Vout_1 (first surface) and Vout_1 (second surface) for the first sheet. Then, the controller corrects the above-described Imon_N+1_d (first surface) and Imon_N+1_d (second surface) on the basis of the video count value of the video count acquiring region (secondary transfer current detection region) of the (N+1)-th (i.e., second) recording material P, and thus acquires secondary transfer current values Imon_N+1 (first surface) and Imon_N+1 (second surface) (S107). A correction method is similar to the correcting method of the case of the first sheet.

Then, the controller 150 compares the secondary transfer current values, each corrected on the basis of the video count value, for the first sheet and the (N+1)-th (second at first) with each other (S108). That is, in this embodiment, the controller 150 discriminates whether or not Imon_N+1 (first surface)>Itr (first surface) is satisfied and whether or not Imon_N+1 (second surface)>Itr (second surface) is satisfied. Further, in the case where the controller 150 discriminated in S108 that the secondary transfer current value for the (N+1)-th (second at first) sheet is larger than the secondary transfer current value for the first sheet ("Yes"), the controller 150 corrects secondary transfer bias set voltage values Vout_N+2 (first surface) and Vout_N+2 (second surface) when an (N+2)-th (third at first) recording material P passes through the secondary transfer portion T2 (S109). That is, in this embodiment, the controller 150 acquires set voltage values Vout_N+2 (first surface) and Vout_N+2 (second surface) for the (N+2)-th (third at first) sheet by the following formulas: Vout_N+2 (first surface)=Vout_N+1 (first surface)+ΔV (first surface), and Vout_N+2 (second surface)=Vout_N+1 (second surface)+Δ (second surface).

On the other hand, in the case where the controller 150 discriminated in S108 that the secondary transfer current value for the (N+1)-th (second at first) sheet is not more than the secondary transfer current value for the first sheet ("No"), the controller 150 does not correct the secondary transfer bias set voltage values Vout_N+2 (first surface) and Vout_N+2 (second surface) (S110). That is, the controller 150 sets Vout_N+2 (first surface)=Vout_N+1 (first surface), and Vout_N+2 (second surface)=Vout_N+1 (second surface).

Then, the controller 150 discriminates whether or not formation of all the images in the job is ended (S111). Then, in the case where the controller 150 discriminated in S111 that the image formation is not ended ("No"), N is incremented by 1 (N=N+1) (S112), and then repeats the processes of S106 and later. Further, in the case where the controller 150 discriminates in S111 that the image formation is ended ("Yes"), the job is ended (S113).

Incidentally, in FIG. 8, for convenience, in S103, S104 and S106-S110, processes for the first surface and the second surface of the recording material P are collectively described, but these processes may be successively performed correspondingly to the first surface and the second surface.

Thus, the image forming apparatus 100 of this embodiment includes the detecting circuit 111 for detecting the current flowing when the voltage is applied to the transfer member 8 by the applying means D2. Further, the image forming apparatus 100 includes the acquiring means (the CPU 151 in this embodiment) for acquiring the index value correlating with the toner amount of the toner image transferred onto the recording material P at the transfer portion T2. Further, the image forming apparatus 100 includes the control means 150 for adjusting the voltage applied to the transfer member 8 when the subsequent recording material P to the certain recording material P passes through the transfer portion T2, on the basis of the detection result of the detecting means 111 in the detection period in which the certain recording material P passes through the transfer portion T2 during continuous image formation in which the images are continuously formed on the plurality of recording materials P, and of the above-described index value relating to the toner image transferred onto the detection region of the recording material P passing through the transfer portion T2 in the above-described direction. In this embodiment, the control means 150 corrects the detection result of the detecting means 111 in the above-described detection period on the basis of the above-described index value relating to the toner image transferred onto the above-described detection region. Then, the control means 150 adjusts, on the basis of the detection result after the correction, the voltage applied to the transfer member 8 when the subsequent recording material P passes through the transfer portion T2. Particularly, in this embodiment, the control means 150 adjusts the voltage applied to the transfer member 8 when the subsequent recording material P passes through the transfer portion T2, on the basis of the first detection result and the first index value for the first recording material P, and the second detection result and the second index value for the certain recording material P which is any one of the second and later recording materials P during continuous image formation. Specifically, in this embodiment, the control means 150 corrects the first detection result on the basis of the first index value and corrects the second detection result on the basis of the second index value, and then adjusts the voltage applied to the transfer member 8 when the subsequent recording material P passes through the transfer portion T2. Further, the control means 150 makes the correction by using the correction efficiency set depending on the index value. The above-described correction efficiency is set so that the absolute value of the detection result of the detecting means 111 in the case where the toner amount indicated by the index value is a second toner amount larger than a first toner amount is corrected to a value larger than a value in the case where the toner amount indicated by the index value is the first toner amount. Further, in this embodiment, the transfer member 8 is a rotatable member, and the length of the above-described detection region of the recording material P with respect to the feeding direction is the substantially integral multiple of circumferential length of the rotatable member. Further, in this embodiment, the acquiring means 151 acquires the index value by counting the video count value correlating with the image density or the image ratio of the toner image transferred from the image bearing member 7 onto the recording material P at the transfer portion T2. Further, in this embodiment, the image bearing member 7 is the intermediary transfer member for feeding the toner image, transferred from another image bearing member 1, in order to transfer the toner image not the recording material P at the transfer portion T2.

As described above, according to this embodiment, the influence of the deviation of the detection result of the secondary transfer current value due to a difference in toner amount on the recording material P is suppressed, so that the set value of the secondary transfer bias can be more appropriately corrected during continuous image formation.

Embodiment 2

Next, another embodiment of the present invention will be described. Basic constitutions and operations of an image forming apparatus in this embodiment are the same as those of the image forming apparatus of embodiment 1. Accordingly, in the image forming apparatus of this embodiment, elements having the same or corresponding functions or constitutions as those of the image forming apparatus in the embodiment 1 are represented by the same reference numerals or symbols as those in the embodiment 1 and will be omitted from detailed description.

This embodiment is different from the embodiment 1 in that the detection result of the secondary transfer current is corrected using correction efficiency which is set in advance for each kind of the recording material and which depends on the video count value. That is, in this embodiment the secondary transfer current is changed depending on the kind of the recording material P.

FIG. 9 is a graph showing a relationship between the video count value (image ratio) correlating with the toner amount on the recording material P and the secondary transfer current value detected when the recording material P passes through the secondary transfer portion T2, with respect to plain paper of 75 gsm in basis weight and thick paper of 300 gsm in basis weight. As is understood from FIG. 9, a ratio of a change in secondary transfer current to a change in video count value (image ratio) is smaller in the case of the thick paper than in the case of the plain paper. As regards the plain paper, in the case where the video count value is 0%, the secondary transfer current value is 40 μA which is a target current value, but in the case where the video count value is 100%, the secondary transfer current value is 35.5 μA, and in the case where the video count value is 200%, the secondary transfer current value is 31 μA. On the other hand, as regards the thick paper, in the case where the video count value is 0%, the secondary transfer current value is 40 μA which is the target current value, but in the case where the video count value is 100%, the secondary transfer current value is 37.5 μA, and in the case where the video count value is 200%, the secondary transfer current value is 35 μA. This is due to the influence of the change in toner amount (video count value) on the recording material P on the change in secondary transfer current being small since the electric resistance of the recording material P itself is higher in the case of the plain paper than in the case of the thick paper.

Table 2 below is a data table showing correction efficiency set in advance depending on the video count value, for correcting the detection result of the secondary transfer current value. The values of the correction efficiency for the plain paper are the same as those shown in Table 1 described in the embodiment 1. On the other hand, as regards the thick paper, for example, in the case where the video count value is 0%, the correction efficiency is 1, in the case where the video count value is 100%, the correction efficiency is 1.08, and in the case where the video count value is 200%, the correction efficiency is 1.15. That is, in the case where the video count values are the same, the correction efficiency for the thick paper is smaller than the correction efficiency for the plain paper (however, in either case of the plain paper and the thick paper, a minimum of the correction efficiency is the same, i.e., 1). Accordingly, the secondary transfer current value (absolute value) is corrected to a smaller value in the case of the thick paper than in the case of the plain paper. Incidentally, in this embodiment, the paper of 150 gsm or less in basis weight is the plain paper, and the paper larger than 150 gsm in basis weight is the thick paper. The data table as shown in Table 2 has been set in advance and has been stored in the ROM 152.

TABLE 2

| Video count value (VC) | Current correction efficiency | |
|---|---|---|
| | PP*1 (BW*2 ≤ 150 gsm) | TP*3 (BW*2 > 150 gsm) |
| 0% | 1 | 1 |
| 0% < VC ≤ 30% | 1.05 | 1.03 |
| 30% < VC ≤ 65% | 1.1 | 1.05 |
| 65% < VC ≤ 100% | 1.15 | 1.08 |
| 100% < VC ≤ 130% | 1.2 | 1.1 |
| 130% < VC ≤ 165% | 1.25 | 1.12 |
| 165% < VC ≤ 200% | 1.3 | 1.15 |

*1"PP" is plain paper.
*2"BW" is the basis weight.
*3"TP" is thick paper.

FIG. 10 is a flowchart of an operation of a job of continuous image formation in this embodiment. Here, the case where the continuous image formation is carried out will be described as an example.

Processes of S201-S213 in FIG. 10 are similar to the processes of S101-S113, respectively, in FIG. 8 in the embodiment 1, and therefore, will be appropriately omitted from redundant description. In this embodiment, a process of S214 is added between S201 and S202.

When the job of the continuous image formation is started by an instruction from the operating portion 120 or the like (S201), the controller 150 acquires information, inputted from the operating portion 120 or the like, on the kind of the recording material P used in the image formation (S214). Incidentally, in the case where an operation for designating the kind of the recording material P is not performed from the operating portion 120 or the like, the controller 150 may discriminate that the recording material P of a predetermined kind such as the plain paper, for example, is to be used. Further, in this embodiment, in S204 and S207 (corresponding to S104 and S107, respectively, of FIG. 8 in the embodiment 1), the controller 150 corrects the detected secondary transfer current value by using the correction efficiency selected from the data table as shown in Table 2 depending on the information, on the kind of the recording material P, acquired in S214.

Thus, in this embodiment, similarly as in the embodiment 1, the control means corrects the detection result of the transfer current by using the correction efficiency set depending on the index value correlating with the toner amount. Then, in this embodiment, the correction efficiency is set for each kind of the recording material P, and the control means 150 carries out the above-described correction by using the correction efficiency depending on the kind of the recording material P fed to the transfer portion T2.

As described above, according to this embodiment, depending on the kind of the recording material P used in the image formation, the secondary transfer bias during continuous image formation can be more appropriately corrected.

Other Embodiments

In the above, the present invention was described based on the specific embodiments, but is not limited to the above-described embodiments.

For example, numerical values used in description in the above-described embodiments are examples, and the present invention is not limited thereto.

Further, in the above-described embodiments, the length of the detection region of the recording material with respect to the feeding direction was the length of the part (which is the substantially integral multiple of the circumferential length of the transfer member 8) of the recording material, but is not limited thereto. For example, the length of the detection region of the recording material with respect to the feeding direction may also be a length of an entirety of the recording material. That is, the transfer current relating to the first sheet of the recording material may also be corrected on the basis of the video count value of the first sheet (recording material) and an average of transfer current values detected when the first sheet passes through the transfer portion. Also as regards the transfer control relating to another sheet of the recording material, a similar manner can be employed.

Further, in the above-described embodiment, the constitution in which the information on the kind of the recording material is inputted from the operating portion or the external device was employed, but the image forming apparatus includes the means for discriminating the kind of the recording material, so that a constitution in which the kind of the recording material is automatically discriminated may also be employed.

Further, in the above-described embodiments, the present invention was applied to the color image forming apparatus, but the present invention is also applicable to a single color (monochromatic) image forming apparatus, so that an effect similar to the effect of the above-described embodiments can be obtained. That is, the present invention is not limited to application to the transfer portion of the toner image from the intermediary transfer member as the image bearing member onto the recording material, but may also be applicable to a transfer portion of the toner image from the photosensitive member or an electrostatic recording dielectric member as the image bearing member onto the recording material.

According to the present invention, during continuous image formation, the set value of the transfer bias can be corrected more appropriately.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-173090 filed on Sep. 14, 2018, which is hereby incorporated by reference herein in its entirety.

What is claimed is:

1. An image forming apparatus comprising:

an image bearing member configured to bear a toner image;

a transfer member configured to transfer the toner image from said image bearing member onto a recording material at a transfer portion under application of a voltage;

a voltage source configured to apply a voltage to said transfer member;

a sensor configured to detect a current flowing when the voltage is applied to said transfer member by said voltage source;

an acquiring portion configured to acquire an index value correlating with a toner amount of the toner image transferred onto the recording material at the transfer portion;

an information storing portion configured to store correction information, determined in advance for each index value, for correcting a detection result of said sensor depending on the index value; and a controller configured to adjust the voltage applied to said transfer member, wherein during continuous image formation for continuously forming images on a plurality of recording materials, the detection result is corrected on the basis of the detection result of said sensor in a detection period in which a current recording material passes through the transfer portion, the index value relating to the toner image transferred onto a detection region passing through the transfer portion in the detecting period, and the correction information, and then on the basis of the corrected value of the detection result, said controller controls the voltage applied to said transfer member for a subsequent recording material passing through the transfer portion.

2. The image forming apparatus according to claim 1, wherein during the continuous image formation, said controller acquires first correction information on the basis of a first detection result which is a detection result of said sensor in a detection period in which a first recording material passes through the transfer portion, a first index value which is the index value relating to the toner image transferred onto a detection region passing through the transfer portion in the detection period, and the correction information, and acquires second correction information on the basis of a second detection result which is a detection result of said sensor in a detection period in which the current recording material which is either one of second and later recording materials passes through the transfer portion, a second index value which is the index value relating to the toner image transferred onto a detection region passing through the transfer portion in the detection period, and the correction information, and then on the basis of the first correction information and the second correction information, said controller adjusts the voltage applied to said transfer member when the subsequent recording material passes through the transfer portion.

3. The image forming apparatus according to claim 2, wherein on the basis of a difference between the first correction information and the second correction information, said controller adjusts the voltage applied to said transfer member when the subsequent recording material passes through the transfer portion.

4. The image forming apparatus according to claim 1, wherein said controller makes the correction by using correction efficiency set depending on the index value.

5. The image forming apparatus according to claim 4, wherein the index value is set for each of kinds of the recording material, and said controller makes the correction by using the correction efficiency depending on the kind of the recording material fed to the transfer portion.

6. The image forming apparatus according to claim 4, wherein a toner amount indicated by the index value includes a first toner amount and a second toner amount greater than the first toner amount, and wherein the correction efficiency is set so that an absolute value of the detection result of said sensor when the toner amount is the second toner amount is corrected to a value greater than an absolute value when the toner amount is the first toner amount.

7. The image forming apparatus according to claim 1, wherein said transfer member is a rotatable member, and wherein a length of the detection region with respect to a recording material feeding direction is a substantially integral multiple of a circumferential length of said rotatable member.

8. The image forming apparatus according to claim 1, wherein said acquiring portion acquires the index value by counting a video count value correlating with an image density or an image ratio of the toner transferred from said image bearing member onto the recording material at the transfer portion.

9. The image forming apparatus according to claim 1, wherein said image bearing member is an intermediary transfer member configured to feed a toner image transferred from another image bearing member so as to transfer the toner image onto the recording material at the transfer portion.

* * * * *